US006193823B1

(12) United States Patent
Morra

(10) Patent No.: US 6,193,823 B1
(45) Date of Patent: Feb. 27, 2001

(54) DELTA-PHASE GRAIN REFINEMENT OF NICKEL-IRON-BASE ALLOY INGOTS

(75) Inventor: Martin M. Morra, Worcester, MA (US)

(73) Assignee: Wyman Gordon Company, North Grafton, MA (US)

( * ) Notice: Subject to any disclaimer, the term of this patent is extended or adjusted under 35 U.S.C. 154(b) by 0 days.

(21) Appl. No.: 09/270,631

(22) Filed: Mar. 17, 1999

(51) Int. Cl.[7] ..... C22F 1/10

(52) U.S. Cl. ..... 148/677; 148/676

(58) Field of Search ..... 148/677, 675, 148/676

(56) References Cited

U.S. PATENT DOCUMENTS

| | | | | |
|---|---|---|---|---|
| 3,660,177 | | 5/1972 | Brown et al. . | |
| 4,614,550 | * | 9/1986 | Leonard et al. . | |
| 5,047,093 | * | 9/1991 | Kimmerle et al. . | |
| 5,059,257 | * | 10/1991 | Wanner et al. . | |
| 5,087,305 | * | 2/1992 | Chang | 148/410 |

OTHER PUBLICATIONS

Anon., "Stability in Superalloys", Proc. of Symposium held Sep. 4–6, 1968, Seven Springs, PA pp. 579–596.
Colin Stead, "The Processing of Inco 718 to Achieve Ultra Fine Grain Size", Cameron Iron Works, Houston TX, 1972.
N.A. Wilkinson, "Forging of 718–The Importance of T.M.P. ", in Superalloy 718, Metallurgy and Applications, The Minerals, Metals & Materials Society, 1989, pp. 119–133.
H.L. Eiselstein, "Metallurgy of a Columbium–Hardened Nickel–Chromium–Iron Alloy," from Advances in the Technology of Stainless Steel and Related Alloys, American Society for Testing and Materials, 1965, pp. 62–79.
L.A. Jackman, "Forming and Fabrication of Superalloys", *Proc. of Symposium on Properties of High Temperature Alloys*, pp. 42–58.
N.A. Wilkinson, "Technological considerations in the forging of superalloy rotor parts", *Metals Technology*, Jul. 1977, pp. 346–359.
D.R. Muzyka, "Physical Metallurgy and Effects of Process Variables on the Microstructure of Wrought Superalloys", reported in Micon 78: Optimization of Processing, Properties and Service Performance Through Microstructural Control, American Society for Testing and Materials, 1979, pp. 526–546.
E.E. Brown, R.C. Boettner, and D.L. Ruckle, in *Proceedings*, Second International Conference on Superalloys, Processing, Report MCIC–72–10, Battelle Columbus Labs, Columbus, Ohio, 1972, pp. L1–L12.
D.R. Muzyka and G.N. Maniar, "Microstructure Approach to Property Optimization in Wrought Superalloys", *Metallography—A Practical Tool for Correlating the Structure and Properties of Materials*, ASTM STP 557, American Society for Testing and Materials, 1974, pp. 198–219.
Chester T. Sims, "A Perspective of Niobium in Superalloys", in Niobium, Proceedings of the International Symposium held Nov. 8–11, 1981, Metallurgical Society of AIME, pp. 1169–1220.
ASTM Standard Test Method E112–95, American Society for Testing And Materials, 1995.

* cited by examiner

*Primary Examiner*—John Sheehan

(57) ABSTRACT

An article is formed from an ingot of a nickel-iron base alloy having a composition including from about 4.5 weight percent niobium to about 5.5 weight percent niobium and capable of forming delta-phase precipitates, and having fewer than about 1 grain per square inch at 100× magnification. An array of intragranular delta-phase precipitates is precipitated within the ingot to provide grain nucleation sites. The ingot having the array of delta-phase precipitates therein is deformed at a temperature below a delta-phase solvus temperature, thereby producing a fine-grained billet.

22 Claims, 3 Drawing Sheets

DELTA-PHASE GRAIN REFINEMENT OF NICKEL-IRON-BASE ALLOY INGOTS

BACKGROUND OF THE INVENTION

This invention relates to the processing of nickel-iron-base alloys, and, more particularly, to the refinement of ingot grains through the precipitation of delta-phase precipitates.

A semifinished wrought nickel-base alloy article is conventionally made by first melting blends of the constituent elements of the alloy. The final cast ingot is produced using one or more cast and remelt steps. Primary thermomechanical working of the ingot (termed "ingot conversion") converts the structure of the cast ingot from a coarse as-cast dendritic grain structure to a fine equiaxed billet grain structure (termed a "cast-wrought" structure). The primary conversion step in highly alloyed metals such as superalloys also serves to break up interdendritic regions, thereby reducing the segregation that occurs during solidification of the ingot. The semifinished billet is then further processed into its final geometry by forging, heat treating, and machining. An example of a nickel-iron-base alloy manufactured into articles by this approach is alloy 718.

Using conventional casting methods the average dendrite grain size in as-cast ingots is typically coarser than ASTM 1 and often coarser than ASTM 00 grain size. If such a material were processed directly into the shape of the final product, an insufficiently high level of strain would be introduced to allow uniform recrystallization of the ingot structure. The result would be non-recrystallized regions that retain the large as-cast grain structure of the ingot. Because grain size is one of the primary parameters controlling properties in these materials, the non-recrystallized regions will typically either fail the microstructural requirements for the final product or, if not detected, will lead to accelerated mechanical failure of the product. The thermomechanical ingot conversion of the ingot into billet prevents the presence of as-cast grains in the billet and also mitigates associated chemical segregation in the billet, ensuring a fine-grain structure in the billet.

Conventional ingot conversion processing is an expensive operation. The function of the primary thermomechanical working is to recrystallize the material using the strain added during each working operation to nucleate new grains at existing grain boundaries. Commercial ingots of nickel-iron-base superalloys often weigh thousands of pounds. Because of the large size of these ingots, it is difficult to achieve a uniformly high level of strain for recrystallization in a single thermomechanical operation. The large-grain areas in the ingot, having a lower grain boundary density, require more cumulative strain to achieve a uniform final grain size. The ingot conversion therefore typically requires multiple upset and draw operations. In theory, the coarser the starting grain size the more thermomechanical operations will be required to refine the grain size.

The equipment to accomplish the multistep thermomechanical conversion in commercial practice is large in size and expensive. The rough thermomechanical working also requires skilled operators, and careful control over the processing practices. This equipment requirement and extensive processing cannot be avoided or significantly reduced in scale under conventional practice because of the non-uniformity in as-cast grain structure due to differences in solidification rates across the large cross-section of the large ingots.

There is a need for an improved approach to the mechanical processing of ingots into final articles, which reduces the required processing and still results in an article of acceptable, or even improved, final quality. The present invention fulfills this need, and further provides related advantages.

SUMMARY OF THE INVENTION

The present invention provides a method of fabricating an article of a nickel-iron-base superalloy. The method of the invention eliminates the need for the multiple primary thermomechanical ingot conversion operations of conventional practices, replacing them with a single, but fully effective, heat treatment of the ingot. The present approach may be used with undeformed ingot material, or with ingot material that has been deformed by a thermomechanical treatment. In either case, the resulting ingot is suitable for final mechanical working into the shape of the semifinished article, and thereafter processing into the final finished article. The present approach may be used with nickel-iron-base alloys that precipitate the non-coherent orthorhombic delta phase $Ni_3Nb$, such as the widely used alloy 718.

In accordance with the invention, a method of fabricating an article comprises the steps of providing an homogenized ingot of a nickel-iron-base alloy having a composition comprising at least about 10 weight percent iron, from about 4.5 weight percent niobium-plus-tantalum to about 5.5 weight percent niobium-plus-tantalum, more nickel by weight than any other element, and capable of forming delta-phase precipitates. Alloy 718 is such a material, having a nominal composition of about 20 weight percent iron, 5 weight percent niobium and a low tantalum content, and about 52.5 weight percent nickel. The ingot also has fewer than about 1 grain per square inch at 100× magnification. In many locations, the ingot typically has fewer than about 0.06 grains per square inch at 100× magnification. The ingot is preferably in the as-cast, homogenized, undeformed state, but it may be deformed to any total strain but not recrystallized prior to precipitation. An array of predominantly intragranular, coarse, noncoherent delta-phase precipitates is precipitated within the ingot, preferably by heating the ingot to a temperature of from about 1600° F. to about 1675° F. The heat treatment temperature should be approached from a lower temperature by heating rather than from a higher temperature by cooling, to avoid the formation of a high volume fraction of intergranular delta phase precipitates that form at higher temperatures. Desirably, the delta-phase precipitates are present in a volume fraction of at least about 20 volume percent. The ingot having the array of intragranular delta-phase precipitates is then deformed at a temperature near to but below the delta-phase solvus temperature of the nickel-iron-base alloy, typically from about 1800° F. to about 1850° F. The deformation may be accomplished by any conventional approach, such as, for example, forging, rolling, extrusion, upsetting, or cogging. After the deformation to produce the semifinished article is complete, final processing such as heat treating and machining may be performed.

In this processing, the array of intragranular, coarse delta-phase precipitates produced by the precipitation heat treatment provides nucleation sites for new, fine grains during the deformation step. Because the heat treatment produces a uniform distribution of delta phase in both fine and coarse grain regions of the ingot, the density of grain nucleation sites results in a uniformly recrystallized grain structure that is substantially independent of the starting grain size. These new fine grains produced during deformation are randomly oriented. The result is that more uniform plastic flow occurs during the subsequent deformation.

The present approach provides an important advance in the fabrication technology of the operable nickel-iron-base alloys. The conventional primary ingot conversion processing that requires multiple thermomechanical steps to produce a fine grain structure is eliminated, and replaced by a thermal treatment of the ingot to precipitate an array of delta phase precipitates that serve as the nucleation sites for fine grains during subsequent deformation. The present approach reduces the number and complexity of processing steps, thereby reducing processing costs.

In the present approach, the delta phase precipitates allow grain nucleation at non-coherent phase boundaries, with the result that the grain nucleation on the delta phase occurs at lower strains than does conventional grain boundary nucleation and recrystallization. Additionally, the present approach reduces niobium segregation by precipitating a large portion of the niobium into the uniform array of delta phase precipitates throughout the structure.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
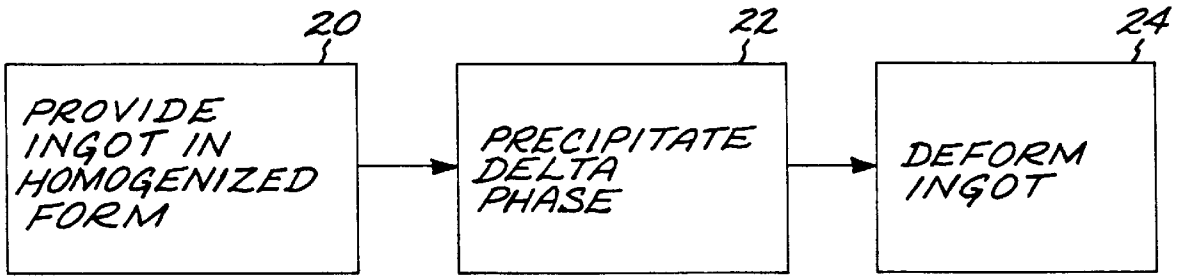
FIG. 1 is a block flow diagram of a first embodiment of a method for practicing the invention.

FIG. 1 is a block flow diagram of a preferred approach for practicing the invention. An ingot of a nickel-iron-base alloy having from about 4.5 weight percent to about 5.5 weight percent total of niobium plus tantalum is provided, numeral 20. The alloy has at least about 10 weight percent iron, and nickel is present in an amount greater than any other element. The alloy is therefore termed "nickel-iron-base". The nickel-iron-base alloy must be capable of forming, under the proper processing conditions, non-coherent delta-phase (δ-phase) precipitates, and the nickel-iron matrix is required for the formation of the delta-phase precipitates. The delta-phase precipitates have a nominal composition based upon $Ni_3Nb$ stoichiometry, or chemical variants thereof, and an orthorhombic crystal structure. The delta-phase precipitates are non-coherent with the matrix in which they precipitate. The non-coherent precipitates serve as nucleation sites for new grains during subsequent processing. If the alloy has less than about 4.5 weight percent niobium, there is an increasing possibility with decreasing niobium content of the competitive formation of eta (η) phase having a hexagonal close packed crystal structure based on $Ni_3Ti$. A different heat treatment would be required to allow the delta phase to form preferentially to the eta phase when less than about 4.5 weight percent niobium is present. If the alloy has more than about 5.5 weight percent niobium, there is an increasing likelihood with increasing niobium content of forming the deleterious Laves phase.

A preferred nickel-base alloy for use in the present invention is alloy 718, having a specification composition, in weight percent, of from about 50 to about 55 percent nickel, from about 17 to about 21 percent chromium, from about 4.75 to about 5.50 percent columbium plus tantalum, from about 2.8 to about 3.3 percent molybdenum, from about 0.65 to about 1.15 percent titanium, from about 0.20 to about 0.80 percent aluminum, 1.0 percent maximum cobalt, and balance iron totaling 100 percent by weight. Small amounts of other elements such as carbon, manganese, silicon, phosphorus, sulfur, boron, copper, lead, bismuth, and selenium may also be present. Within these specification ranges, a typical nominal commercial composition of alloy 718 is, in weight percent, about 52.5 percent nickel, about 18.35 percent iron, about 19 percent chromium, about 5.3 percent niobium, about 3.05 percent molybdenum, about 0.9 percent titanium, about 0.5 percent aluminum, and about 0.4 percent cobalt, balance minor elements.

The ingot is a body of solid metal that has been cast from molten metal. The ingot is homogenized, which is typically achieved in the case of alloy 718 by first heating the as-cast ingot to a temperature of about 200° F. below the liquidus temperature of the alloy. In this embodiment of FIG. 1, the ingot is in its as-cast, undeformed state. The ingot is typically quite large and heavy in commercial-scale operations, at least about 3500 pounds and typically on the order of 10,000–25,000 pounds or larger. That the ingot has a weight of at least about 3500 pounds is significant, because substantially smaller ingots exhibit more uniform, smaller-size as-cast grain structures because they cool more rapidly and uniformly following solidification. In the case of the larger ingots of more than about 3500 pounds, the grain structure is more coarse and irregular, with grains near the center of the ingot coarser than those near the exterior surface of the ingot. Such large ingots (i.e., those having a weight of more than about 3500 pounds) are significantly more difficult to process into acceptable billet by conventional ingot conversion than are the smaller ingots, because of the large grains and irregular grain structure.

Figure 2:
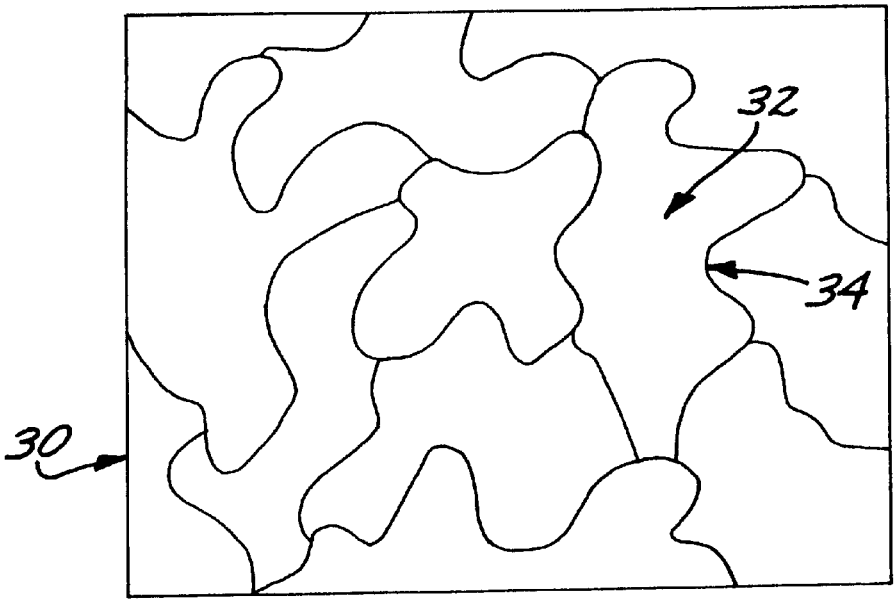
FIG. 2 is an idealized representative microstructure of an as-cast ingot at a nominal magnification of 1×.

In normal solidification practice, the large ingot is characterized by a coarse grain structure, as illustrated in FIG. 2. Here, the structure 30 contains coarse grains 32 with grain boundaries 34 between the grains. The grains have fewer than about 1 grain per square inch at 100× magnification (ASTM 1 grain size or larger), and more typically have fewer than about 0.25 grain per square inch at 100× magnification (ASTM 00 grain size or larger). The grain sizes are measured in accordance with the ASTM E112 Specification. Generally in this approach, a metallographic section of the material is prepared and etched to reveal grain boundaries. The section is viewed at 100× magnification, and the number of grains present per square inch, at that 100× magnification, is counted. Equivalently, the grain sizes may be measured in ASTM Macro grain sizes (M), where ASTM 1 grain size measured at 100× corresponds to ASTM M14.3 grain size measured at 1× with a mean grain diameter of about 0.010 inch or larger, and ASTM 00 grain size measured at 100× corresponds to ASTM M12.3 grain size measured at 1× with a mean grain diameter of about 0.020 inch or larger. More detail of the definitions and procedures involving standard and macro grain size measurements is provided in the ASTM E112 Specification.

The coarse grain structure makes the ingot difficult to deform easily to billet because the large grains inhibit compatible metal flow during hot working. The ingot is prone to cracking if subjected to large deformations in a single working operation, to achieve a sufficiently high effective strain for recrystallization based on grain boundary sites. Recrystallization at grain boundary sites requires an effective strain of about 0.7, which is too high a strain to introduce uniformly throughout the cross section of a typical large ingot in a single step without cracking it. Conventional ingot conversion practice utilizes multiple upset and draw operations at high temperature to safely recrystallize the material. By contrast, in the present approach the use of delta phase as a non-coherent precipitation site reduces the effective strain required to cause recrystallization to about 0.3, so that the maximum reduction required to recrystallize the ingot is smaller than for the conventional practice.

Returning to FIG. 1, the ingot is processed to precipitate an array of intragranular delta-phase precipitates within the ingot, numeral 22. The processing is preferably thermal processing (i.e., heat treating), as distinct from thermomechanical processing (i.e., heat treating combined with mechanical deformation), although thermomechanical processing may be used in some cases. The precipitation treatment 22 heats the ingot to a temperature of from about 1600° F. to about 1675° F. This range is established by reference to the nose of the time-temperature-transformation diagram for the precipitation of delta phase in the nickel-iron-base alloy, which is at approximately 1650° F. for alloy 718. If the temperature of the precipitation treatment is too high, substantially above about 1675° F., the precipitation of delta phase tends to be predominantly intergranular rather than the desired intragranular precipitation. The precipitation in the range of from about 1650° F. to about 1675° F. is mixed intergranular and intragranular, but there is sufficient intragranular precipitation for operability of the invention. Precipitation in the range of from about 1600° F. to about 1650° F. is predominantly intragranular, the desired form. Precipitation below about 1600° F. is too slow for achieving the desired volume fraction of precipitates in commercially viable times. A preferred precipitation treatment is to heat the ingot to a precipitation-treatment temperature of from about 1600° F. to about 1675° F. for a precipitation-treatment time of from about 10 to about 20 hours. The precipitation-treatment time is measured after the ingot has equilibrated at the precipitation-treatment temperature. The equilibration time varies according to the size of the ingot and may be determined from conventional heat flow calculations. The most preferred precipitation treatment 22 is 1650° F. for 10 hours after equilibration. In all of the heat treatments, the ingot is preferably heated to the precipitation-treatment temperature from a lower temperature, rather than cooled to the precipitation-treatment temperature from a higher temperature, to avoid the formation of a high volume fraction of intergranular delta phase precipitates that form at temperatures above about 1675° F.

Figure 3:
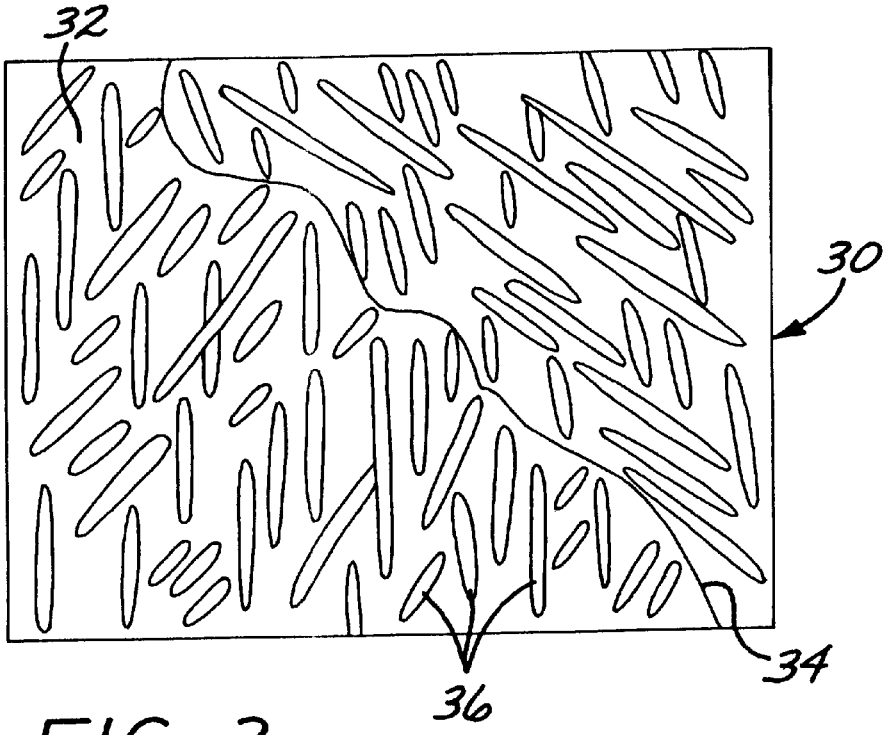
FIG. 3 is an idealized representative microstructure of the as-cast ingot, after precipitation of delta-phase therein, at a nominal magnification of 1000×.

FIG. 3 illustrates the locations of the delta-phase precipitates 36 in the structure 30 of FIG. 2. The precipitates 36 are generally, but not necessarily exactly, plate-like acicular. The precipitates may be described by their short a-axis (platelet thickness), b-axis (platelet width), and c-axis (platelet length). The least significant of these dimensions for the present processing is the c-axis, which in some precipitated forms may equal the diameter of the grain in which it has precipitated. The b-axis dimension (platelet width) of the delta-phase in the acicular platelet morphology should be a minimum of about 1 micrometer. The short a-axis dimension is much less than the c-axis dimension and is less than the b-axis dimension. In the rod-like morphologies, the b-axis and c-axis dimensions are approximately equal. A useful effective value to characterize the precipitates 36 is the sum of the two transverse dimensions perpendicular to the c-axis plate length, i.e., the sum of the a-axis dimension and the b-axis dimension, which should be at least 1 micrometer. If the precipitates are too small, they are not as effective as the larger precipitates in subsequent nucleation of new grains. If the precipitates are too large, their area density is too low and it is difficult to achieve a homogeneous distribution of the precipitates in step 22.

The precipitates 36 are predominantly intragranular, rather than intergranular. That is, the precipitates 36 lie within the grains 32, without crossing or pinning the grain boundaries 34. A few precipitates 36 may incidentally lie at the grain boundaries 34, but the great majority of the delta-phase precipitates 36 are within the grains and do not contact the grain boundaries 34. If the precipitates are not intragranular with a generally uniform spatial distribution within the ingot after step 22, they do not have the necessary distribution to provide nucleation sites for new, fine grains in subsequent deformation processing.

The precipitates 36 are preferably present in an amount of at least about 10 volume percent of the total volume of the ingot, more preferably from about 15 to about 25 volume percent, and most preferably about 20 volume percent in any area examined within the ingot. A substantially smaller volume fraction of precipitates will result in too low a nucleation site density for new grains in the subsequent deformation processing.

After the precipitation step 22 is completed, the ingot is deformed, numeral 24 of FIG. 1. The deformation 24 accomplishes the reduction of thickness of the ingot to reach the required size of the semifinished article, and may also deform the ingot to the required shape of the semifinished article (i.e., near-net-shape processing). The deformation 24 may be of any operable type, such as, for example, forging, rolling, extrusion, upsetting, and cogging.

The deformation 24 must be accomplished at a temperature below the solvus temperature of the delta-phase precipitates 36, or below about 1850° F. in the usual case. Preferably, the deformation 24 is accomplished at a temperature of from about 1800° F. to about 1825° F. The time at 1825° F. should not exceed a maximum of about 6 hours exposure prior to the commencement of deformation, however, because of the high probability of dissolving of the delta-phase precipitates.

Figure 4:
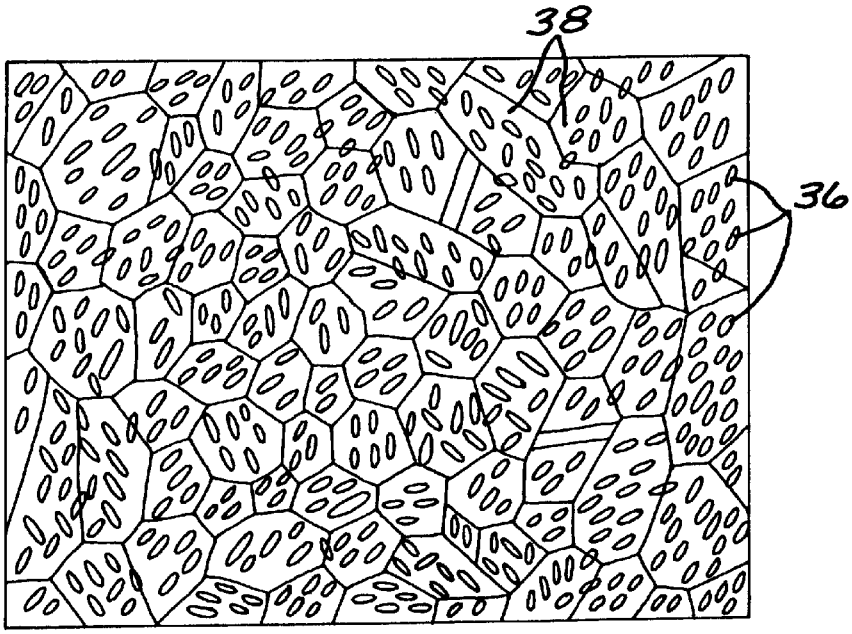
FIG. 4 is an idealized representative microstructure of the as-cast and precipitated ingot, after deformation processing, at a nominal magnification of 1000×.

The elevated-temperature deformation 24 introduces sufficient strain into the ingot to impart the required energy for recrystallization of the alloy to produce a distribution of new, fine grains, nucleated on the pre-existing delta-phase precipitates 36. In a usual case, the deformation 24 introduces an effective strain of at least about 0.3 into the ingot. Dependent upon the strain and strain rates used, recrystallization of new, fine grains proceeds both during deformation and during thermal treatment after the deformation. FIG. 4 illustrates the resulting structure. (Note that FIG. 4 is at a much higher magnification than FIG. 3.) The large grains 32 of the ingot structure of FIGS. 2 and 3 have been replaced by small, uniform, randomly oriented grains 38. The grains 38 nucleate on the pre-existing delta-phase precipitates 36, and are therefore to some extent centered on the precipitates 36. This fine-grain structure may be deformed by large amounts in the deformation step 24, without experiencing inhomogeneous strain distributions and deformation failures as would occur for large-grain material such as the ingot structure 30 of FIGS. 2 and 3. The fine-grain structure is achieved without the need for multiple thermomechanical conversion operations performed on the ingot to produce the fine-grain structure.

The present approach reduces the number of processing steps required, and also produces a final billet structure after step 24 that is superior to the billet structure produced by conventional conversion processing in at least two respects. First, conventional conversion-processed billets exhibit banding of layers of elongated large grains that have been deformed but not recrystallized. This phenomenon results from the inhomogeneity in as-cast grain structure in the large ingot. The present approach produces a billet that does not have such banding, because the delta phase is precipitated in step 22 to nucleate the uniformly fine grain structure during the deformation step 24. Second, there is a substantial amount of niobium segregation through the thickness of the billet. The segregation is greatly reduced by the present approach because the niobium is precipitated as the delta phase in a generally uniform distribution. Because of these improvements to the billet structure when the billet is prepared by the present approach, the structure of the final product is improved as well.

Figure 5:
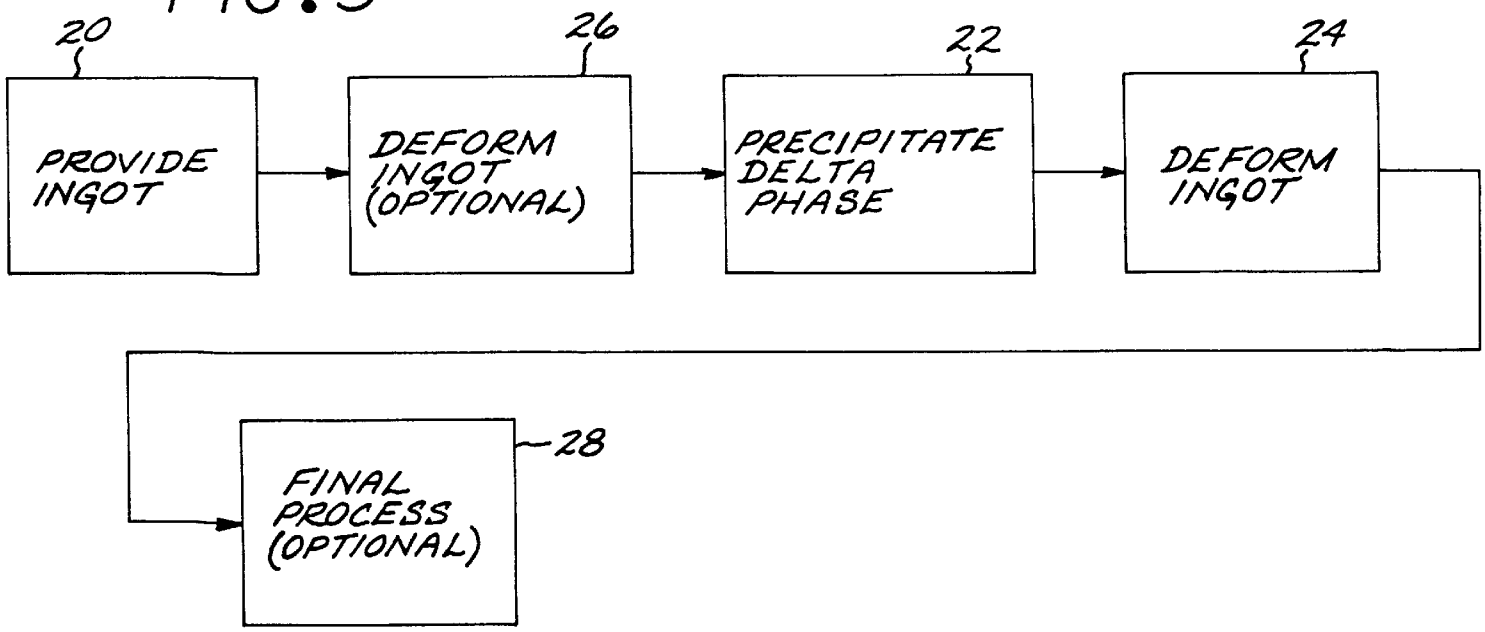
FIG. 5 is a block flow diagram of a second embodiment of a method for practicing the invention.

FIG. 5 illustrates a method in accordance with a second embodiment of the invention. The method of FIG. 5 utilizes the same steps 20, 22, and 24 discussed above, and that discussion is incorporated here.

The approach of FIG. 5 differs in the optional addition of two further steps. In the first, the ingot provided in step 20 may be deformed, numeral 26, after step 20 and prior to step 22. The deformation of step 26 may be sufficient to produce a minimum effective strain in the ingot of from about 20 percent to about 30 percent, but smaller or greater reductions are permissible as well. The deformation 26 may be required to allow the ingot to fit within available processing equipment used in step 24, for example. This deformation 26 serves to promote the subsequent recrystallization of the surface grains of the ingot. However, it is important that, if a deformation step 26 is utilized, there be no recrystallization of the deformed ingot after step 26 and before the precipitation step 22.

Figure 6:
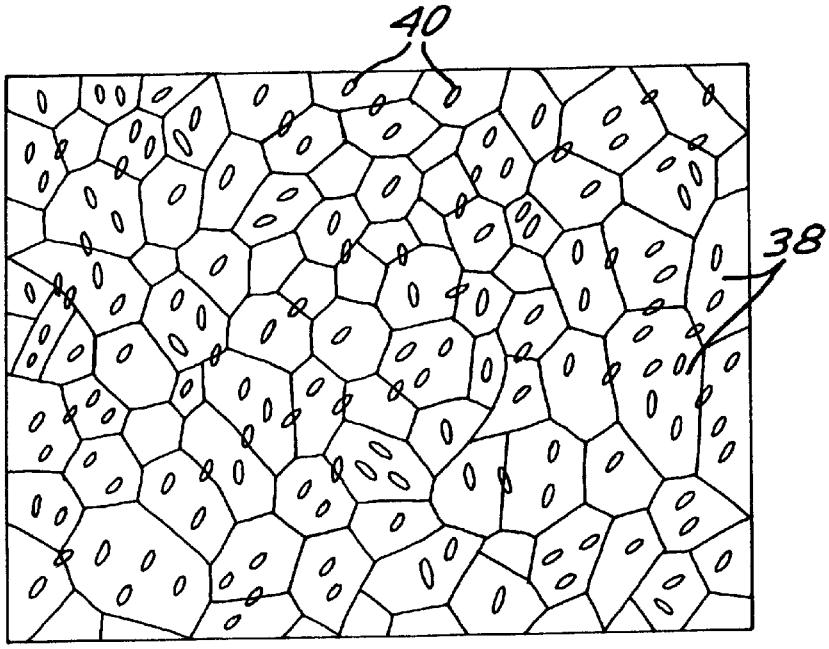
FIG. 6 is an idealized microstructure of the deformation processed ingot, after further heat treatment, at a nominal magnification of 1000×.

In a second optional step, the semifinished article produced in step 24 may be final processed, numeral 28. The final processing may be of any required type. In one type of final processing, the finish forged article is machined to the required final shape. In another type of final processing, the finish forged article is heat treated to establish its strength and/or microstructure. In one heat treatment, the finish forged article is heated to a temperature sufficient to dissolve a portion of the delta-phase precipitates, thereby reducing the volume fraction of delta-phase precipitates in the final article. For example, in an application of interest to the inventor, the finish forged article may be heated to a temperature of from about 1825° F. to about 1850° F., for a time of from about 2 hours at 1825° F. to about 0.5 hours at 1850° F., to reduce the volume fraction of the delta-phase precipitate to about 3 volume percent from the higher volume percent required in the deformation step 24. The lower volume fraction resulting from the heat treatment in step 28 is more suitable for providing the desired mechanical properties in the final article. FIG. 6 illustrates the resulting microstructure, having grains 38 comparable to those in FIG. 4, but with much smaller and fewer precipitates 40 that result from the dissolution or partial dissolution of the precipitates 36 of FIG. 4. Care is taken in this final heat treatment that the article is not heated to a temperature so high that there is significant grain coarsening.

The present invention has been reduced to practice using a full-scale ingot of alloy 718. The ingot weighed about 4000 pounds, and had an initial grain size of greater than ASTM 00. The as-cast ingot, having a microstructure like that shown in FIG. 2, was heated to a temperature of 1650° F. for 10 hours to produce a microstructure like that shown in FIG. 3. The ingot was then extruded at a temperature of 1825° F. and with an effective strain of from 60 to 200 percent, depending on the location within the ingot. The completed billet had a microstructure like that of FIG. 4, with a generally uniform grain size in the ASTM 10–12 range. This billet is suitable for further processing.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating an article, comprising the steps of:

providing an ingot of a nickel-iron-base alloy having a composition comprising at least about 10 weight percent iron, from about 4.5 weight percent niobium to about 5.5 weight percent niobium, more nickel by weight than any other element therein, and capable of forming delta-phase precipitates, the ingot having fewer than about 1 grain per square inch at 100× magnification;

precipitating an array of intragranular delta-phase precipitates within the ingot; and deforming the ingot having the array of delta-phase precipitates therein at a temperature below a delta-phase solvus temperature of the nickel-base alloy.

2. The method of claim 1, wherein the nickel-base alloy has a nominal composition, in weight percent, of abut 52.5 percent nickel, about 18.35 percent iron, about 19 percent chromium, about 5.3 percent niobium, about 3.05 percent molybdenum, about 0.9 percent titanium, about 0.5 percent aluminum, and about 0.4 percent cobalt, balance minor elements.

3. The method of claim 1, wherein the step of providing includes the step of providing the ingot in an as-cast, undeformed state.

4. The method of claim 1, wherein the step of providing includes the step of providing the ingot in an as-cast, undeformed state; and initially deforming the ingot so that its thickness is reduced, there being no recrystallization of the initially deformed ingot prior to the step of precipitating.

5. The method of claim 1, wherein the step of providing includes the step of providing the ingot in an as-cast, undeformed state; and initially deforming the ingot so that its thickness is reduced by at least about 20 percent, there being no recrystallization of initially the deformed ingot prior to the step of precipitating.

6. The method of claim 1, wherein the step of precipitating includes the step of heating the ingot to a temperature of from about 1600° F. to about 1675° F.

7. The method of claim 1, wherein the step of precipitating includes the step of heating the ingot to a temperature of from about 1600° F. to about 1675° F. for a time of from about 10 to about 20 hours.

8. The method of claim 1, wherein the step of precipitating includes the step of precipitating at least about 20 volume percent of delta-phase precipitates in the ingot.

9. The method of claim 1, wherein the step of precipitating includes the step of precipitating delta-phase precipitates having acicular platelet morphology and a value of a sum of a first transverse dimension and a second transverse dimension of at least about 1 micrometer.

10. The method of claim 1, wherein the step of deforming includes the step of forging the ingot having the array of delta-phase precipitates therein.

11. The method of claim 1, wherein the step of deforming includes the step of rolling the ingot having the array of delta-phase precipitates therein.

12. The method of claim 1, wherein the step of deforming includes the step of extruding the ingot having the array of delta-phase precipitates therein.

13. The method of claim 1, wherein the step of deforming includes the step of upsetting the ingot having the array of delta-phase precipitates therein.

14. The method of claim 1, including an additional step, after the step of deforming, of heat treating the deformed ingot at a temperature below the delta-phase solvus.

15. The method of claim 1, wherein the step of providing includes the step of providing the ingot having fewer than about 0.25 grain per square inch at 100× magnification.

16. The method of claim 1, wherein the step of deforming includes the step of deforming the ingot at a temperature of greater than about 1800° F.

17. The method of claim 1, wherein the step of deforming includes the step of deforming the ingot at a temperature of greater than about 1800° F. and less than about 1850° F.

18. The method of claim 1, wherein the step of providing an ingot includes the step of providing an ingot weighing more than about 3500 pounds.

19. A method of fabricating an article, comprising the steps of:

providing an ingot of a nickel-iron-base alloy having a weight of more than about 3500 pounds and a composition comprising at least about 10 weight percent iron, from about 4.5 weight percent niobium to about 5.5 weight percent niobium, more nickel by weight than any other element therein, and capable of forming delta-phase precipitates, the ingot having been subjected to less than about 30 percent total strain in reduction operations; thereafter precipitating an array of intragranular delta-phase precipitates within the ingot; and thereafter deforming the ingot having the array of delta-phase precipitates therein at a temperature below a delta-phase solvus temperature of the nickel-base alloy.

20. A method of fabricating an article, comprising the steps of:

providing an ingot having a nominal composition, in weight percent, of from about 50 to about 55 percent nickel, from about 17 to about 21 percent chromium, from about 4.75 to about 5.50 percent columbium plus tantalum, from about 2.8 to about 3.3 percent molybdenum, from about 0.65 to about 1.15 percent titanium, from about 0.20 to about 0.80 percent aluminum, 1.0 percent maximum cobalt, balance iron totaling 100 percent by weight, the ingot having fewer than about 1 grain per square inch at 100× magnification; thereafter precipitating an array of intragranular delta-phase precipitates within the ingot by heating the ingot to a temperature of from about 1600° F. to about 1675° F.; and thereafter deforming the ingot having the array of delta-phase precipitates therein at a temperature at a temperature of greater than about 1800° F. and less than about 1850° F.

21. A method of fabricating an article, comprising the steps of:

providing an ingot of a nickel-iron-base alloy having a composition comprising at least about 10 weight percent iron, from about 4.5 weight percent niobium to about 5.5 weight percent niobium, more nickel by weight than any other element therein, and capable of forming delta-phase precipitates, the ingot having fewer than about 1 grain per square inch at 100× magnification;

precipitating an array of intragranular delta-phase precipitates within the ingot; and deforming the ingot having the array of delta-phase precipitates therein at a temperature below a delta-phase solvus temperature of the nickel-base alloy, the array of delta-phase precipitates serving to nucleate an array of new recrystallized grains.

22. The method of claim 21, wherein the array of new recrystallized grains is substantially independent of a starting grain size of the ingot.

* * * * *